United States Patent [19]

Maejima

[11] Patent Number: 4,580,297

[45] Date of Patent: Apr. 8, 1986

[54] SKI PANTS

[75] Inventor: Seiichi Maejima, Nara, Japan

[73] Assignee: Descente Ltd., Osaka, Japan

[21] Appl. No.: 650,533

[22] Filed: Sep. 14, 1984

[30] Foreign Application Priority Data

Feb. 8, 1984 [JP] Japan ..... 59-15440[U]

[51] Int. Cl.[4] ..... A41D 13/06

[52] U.S. Cl. ..... 2/22; 2/24

[58] Field of Search ..... 2/22, 23, 24

[56] References Cited

U.S. PATENT DOCUMENTS 3,259,910 7/1966 Daignault ..... 2/24

3,411,222 11/1968 Williams ..... 2/24 X 3,670,339 6/1972 Cooper et al. ..... 2/24

4,450,832 5/1984 Waddell ..... 2/22

4,512,037 4/1985 Vacanti ..... 2/22 X

*Primary Examiner*—Louis K. Rimrodt

*Attorney, Agent, or Firm*—Oblon, Fisher, Spivak, McClelland & Maier

[57] ABSTRACT

Ski pants have a pair of protective pads formed from an elastic material, and each extending from the upper edge of the knee on one of the legs to at least the mid-portion of the skin. Each pad includes a knee portion and a shin portion, and has a plurality of first projections formed on each of its knee and shin portions. The knee portion further includes a plurality of second projections formed on the first projections.

4 Claims, 2 Drawing Figures

SKI PANTS

BACKGROUND OF THE INVENTION

1. Field of the Invention

This invention relates to ski pants, and more particularly, to ski pants for a skier participating in a high-speed race. More particularly, it is concerned with the knee and shin protecting pads on the ski pants.

2. Description of the Prior Art

The ski pants worn by a skier in a high-speed skiing race, such as a downhill race or giant slalom, have their knees and shins frequently brought into violent contact with snow. This brings about not only a reduction in the speed of skiing, but often an injury to the skier as well. Thus, ski pants tend to be made of cloth having a greater thickness in order to protect the skier against injury. While it may be true that ski pants made of thicker cloth are effective for the skier's protection, they have the disadvantage of slowing movement of the skier.

SUMMARY OF THE INVENTION

It is an object of this invention to provide ski pants which protect a skier against any injury in the event his knees and shins are frequently brought into contact with snow at a high speed, while ensuring his quick motion and a high skiing speed.

This object is attained by ski pants having a pair of protective pads formed from an elastic material, and each extending from the upper edge of the knee on one of the legs to the midportion of the shin, each pad comprising a multiplicity of projections, each of the projections on the knee having a button-like second projection formed thereon. The first projections may have a thickness of, say, 2 to 8 mm.

The pads of such construction provide an excellent effect of protection without bringing about any substantial increase in the weight of ski pants, any reduction in their wearing comfort or any appreciable frictional resistance leading to a reduction in skiing speed in the event they are brought into contact with snow.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
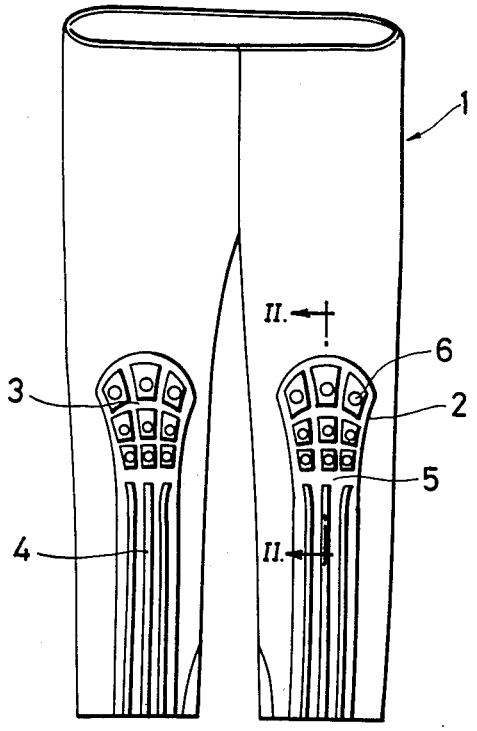
FIG. 1 is a front elevational view of the ski pants according to the present invention.
Figure 2:
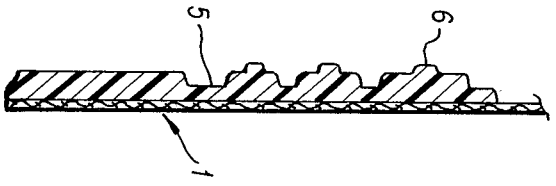
FIG. 2 is a partial sectional view of the ski pants in accordance with the present invention taken along line II—II of FIG. 1.

Referring to the drawings, ski pants embodying this invention are generally shown at 1, and have a pair of protective pads 2 each extending from the upper edge of the knee on one of the legs to the lower edge of the shin. Each pad 2 comprises a knee portion 3 and a shin portion 4. The knee portion 3 comprises a plurality of first projections which are appropriately arranged to protect the knee. The projections are preferably disposed radially from the lower edge 5 of the knee to its upper edge in order to avoid resistance leading to a reduction in skiing speed. The projections may be of any shape, such as rectangular, circular, trapezoidal or triangular. They are preferably so sized as to each have a surface area of, say, 3 to 20 $cm^2$ in order to enable the pants to provide a good wearing comfort.

The shin portion 4 may comprise similar projections, but it is usually preferable that the shin portion 4 have a plurality of elongated projections extending from the lower edge 5 of the knee to the lower edge of the shin in order to provide full protection for the skier's shin. There is, however, no problem in particular if the projections are provided at least in an area between the lower edge 5 of the knee and the midportion of the shin.

The projections in the knee and shin portions 3 and 4 may be formed from an elastic material, such as felt, foamed plastics or rubber. They preferably have a thickness of, say, 2 to 8 mm. A smaller thickness fails to provide satisfactory results of protection, while a greater thickness results in a poor wearing comfort.

The projections can be secured to the pants by, for example, sewing or adhesive bonding. Alternatively, each pad may include a base sheet of an elastic material on which the projections are formed, and which is secured to the pants by, for example, sewing or adhesive bonding.

The knee portions 3 are more liable to be impacted than any other portion in the event the skier has fallen down during skiing. According to a salient feature of this invention, therefore, the knee portion 3 of each pad 2 has a plurality of button-like second projections 6 formed on the first projections. The second projections 6 may be formed each on one of the first projections. They may be formed from, for example, a metallic, plastic or ceramic material, and may be of any shape similar to, or different from, that of the first projections. The projections 6 provide improved protection for the skier.

Obviously, numerous modifications and variations of the present invention are possible in light of the above teachings. It is therefore to be understood that within the scope of the appended claims, the invention may be practiced otherwise than as specifically described herein.

What is claimed is:

1. Ski pants having a pair of protective pads formed of an elastic material, and each extending from the upper edge of the knee on one of the legs to at least the mid-portion of the shin, each of said pads comprising a knee portion and a shin portion, and having a plurality of first projections formed on each of said knee and shin portions, wherein said knee portion further comprises a plurality of second projections formed on said first projections, said first projections on said knee portion are disposed radially from the lower edge of the knee to said upper edge thereof, are generally rectangular, and have a size which increases toward said upper edge of the knee and wherein said shin portion further comprises a plurality of elongated projections extending from a lower edge of said knee portion to a lower edge of said shin portion.

2. Ski pants as set forth in claim 1, wherein said first projections have a thickness of about 2 to about 8 mm.

3. Ski pants as set forth in claim 2, wherein said elastic material is selected from the group consisting of felt, foamed plastics and rubber.

4. Ski pants as set forth in claim 3, wherein said second projections are formed from a material selected from the group consisting of metallic, plastic and ceramic materials.

* * * * *